United States Patent [19]

Sauer et al.

[11] 4,018,020

[45] Apr. 19, 1977

[54] MODULAR WALL CONSTRUCTION

[75] Inventors: Gale E. Sauer, Williamsville; Barton G. Hansen, Cheektowaga, both of N.Y.

[73] Assignee: Roblin Industries, Inc., Buffalo, N.Y.

[22] Filed: Apr. 16, 1975

[21] Appl. No.: 568,397

Related U.S. Application Data

[62] Division of Ser. No. 411,703, Nov. 1, 1973, Pat. No. 3,925,948.

[52] U.S. Cl. ..... 52/241; 52/278; 52/481; 52/464; 52/489; 52/632; 52/715

[51] Int. Cl.[2] ..... E04B 2/28

[58] Field of Search ..... 52/241, 242, 243, 481, 52/489, 632, 715, 735, 737, 738, 758 H; 248/295, 298

[56] References Cited

UNITED STATES PATENTS

| | | | |
|---|---|---|---|
| 1,074,242 | 9/1913 | Caldwell | 52/243 |
| 1,791,197 | 2/1931 | Dickson | 52/243 |
| 2,658,241 | 11/1953 | Houghton | 52/632 |
| 3,102,306 | 9/1963 | Hutchinson | 52/632 |
| 3,397,495 | 8/1968 | Thompson | 52/241 |
| 3,492,766 | 2/1970 | Andrews | 52/632 |
| 3,593,475 | 7/1971 | La Gue | 52/241 |
| 3,722,163 | 3/1973 | Satkin | 52/241 |

*Primary Examiner*—Leslie Braun
*Attorney, Agent, or Firm*—Christel & Bean

[57] ABSTRACT

Spaced panel bearing studs are vertically arranged to receive and support panel members defining a wall surface. The studs are maintained in a spaced apart relation by detachable spacer bars extending therebetween and releasably engaged therewith. The panel members can be adhesively secured to the studs or mechanically secured in place by separate batten strips or by skirt portions formed integral with the panel members. The batten strips and skirts are each provided with tongues having enlarged formations interlockingly engagable with clips detachably mounted on the studs. Axially adjustable extender clips are insertable in the upper ends of the studs for connecting the studs to ceiling channel members.

5 Claims, 14 Drawing Figures

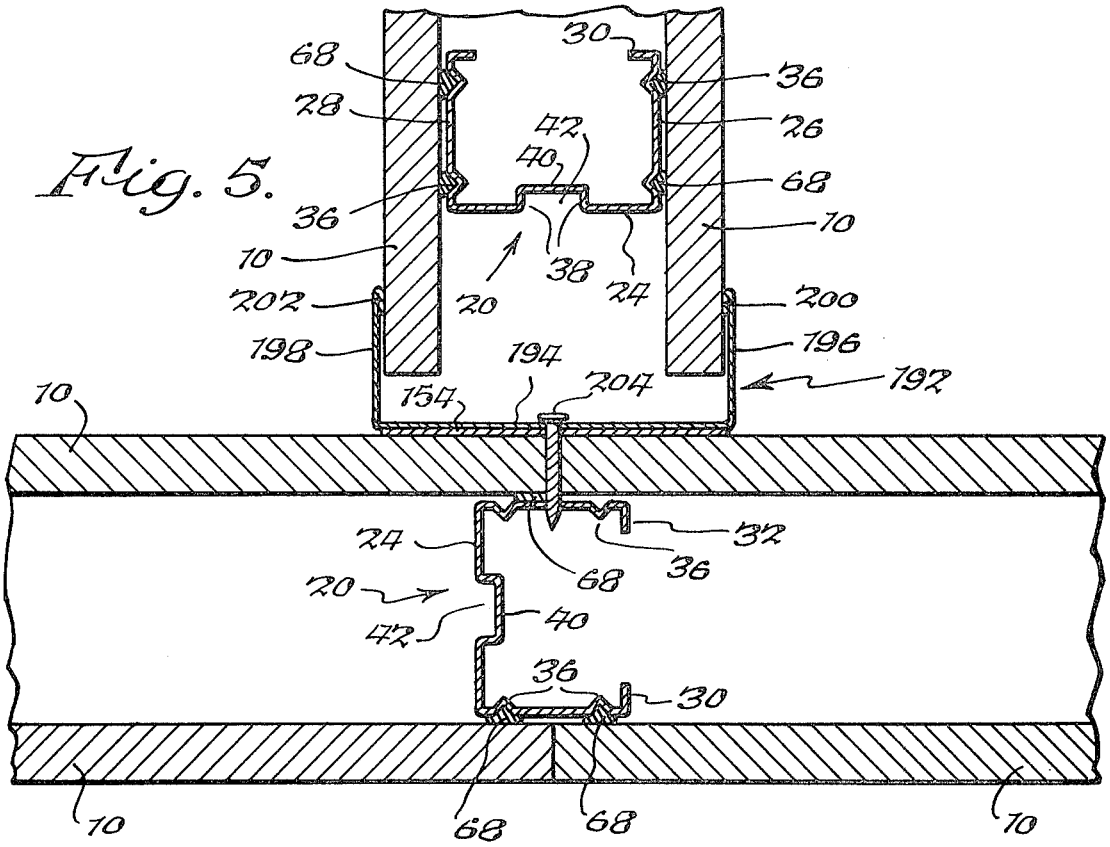
Fig. 5.
Fig. 6.
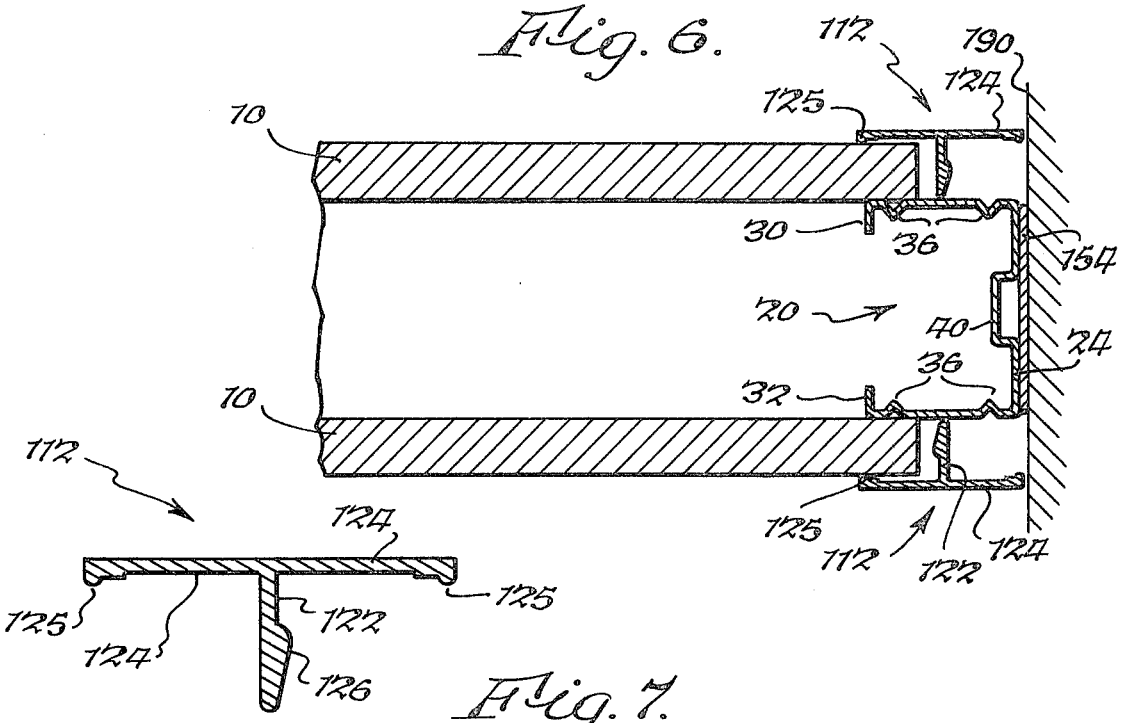
Fig. 7.

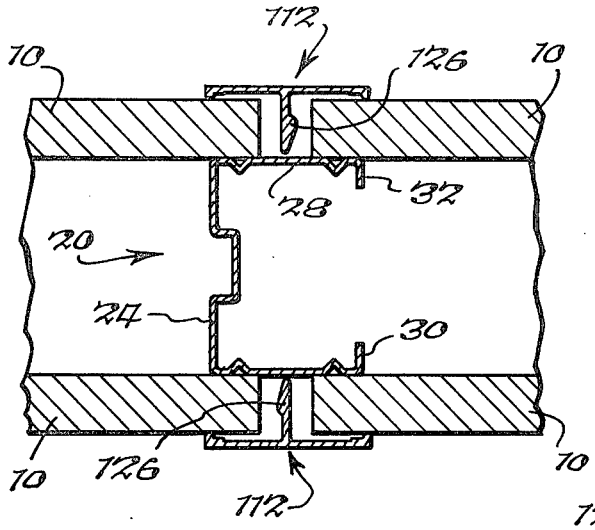
Fig. 8.
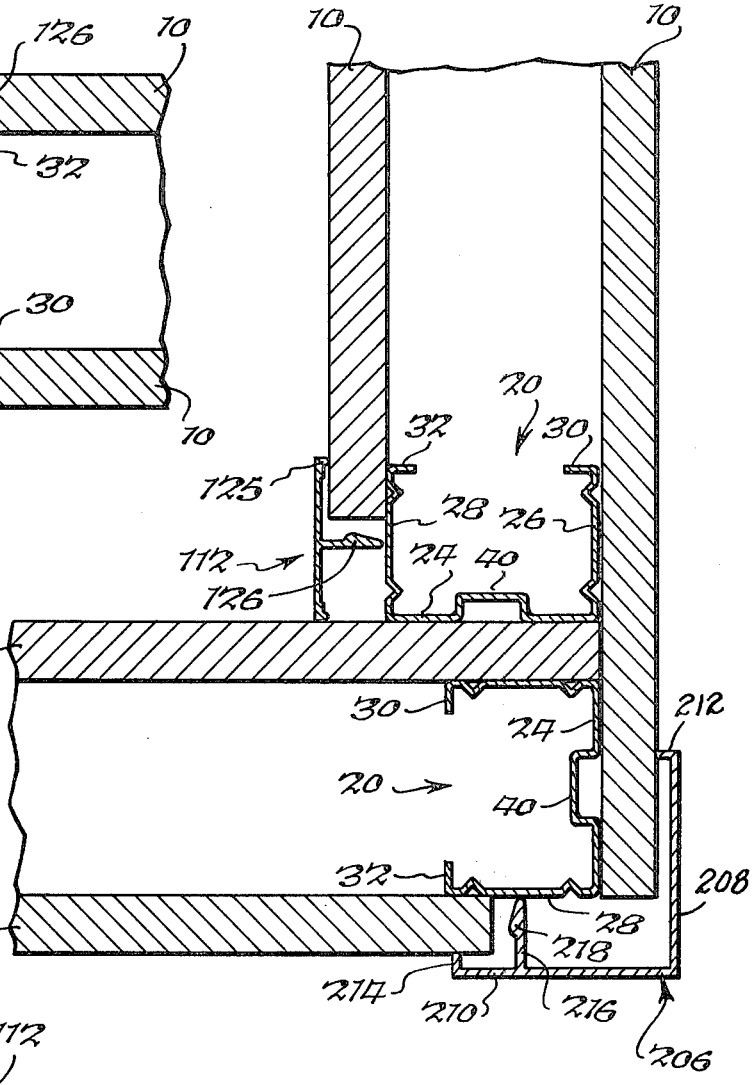
Fig. 9.
Fig. 11.
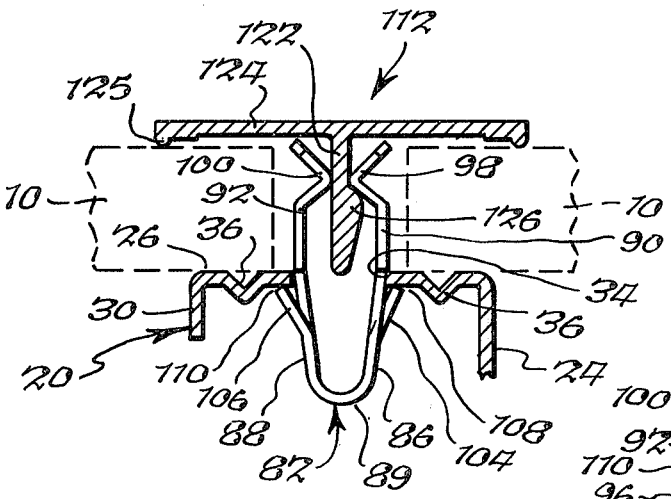
Fig. 10.
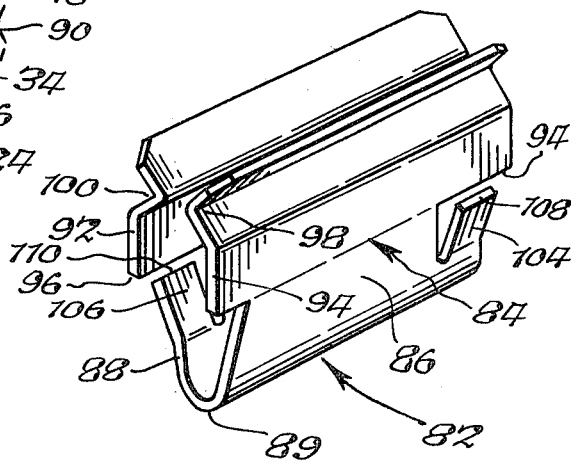

Fig. 12.
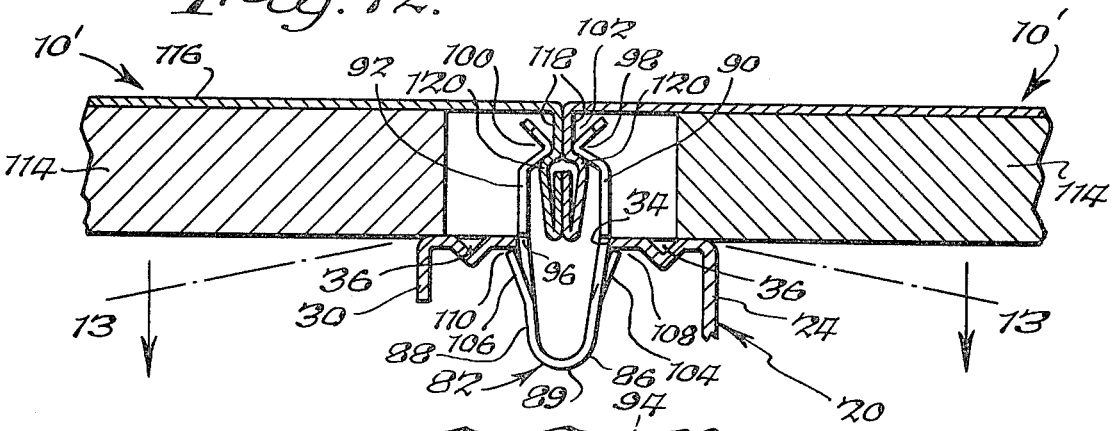
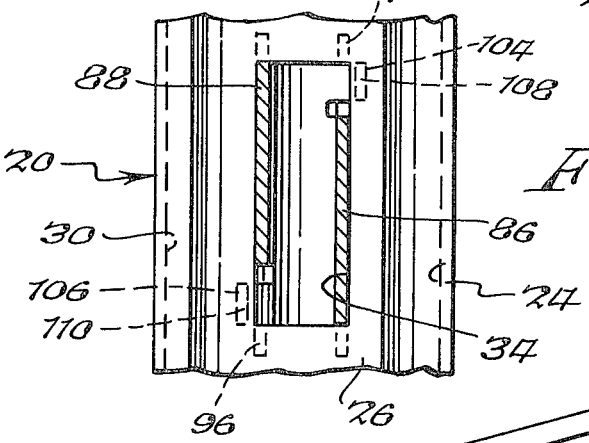
Fig. 13.
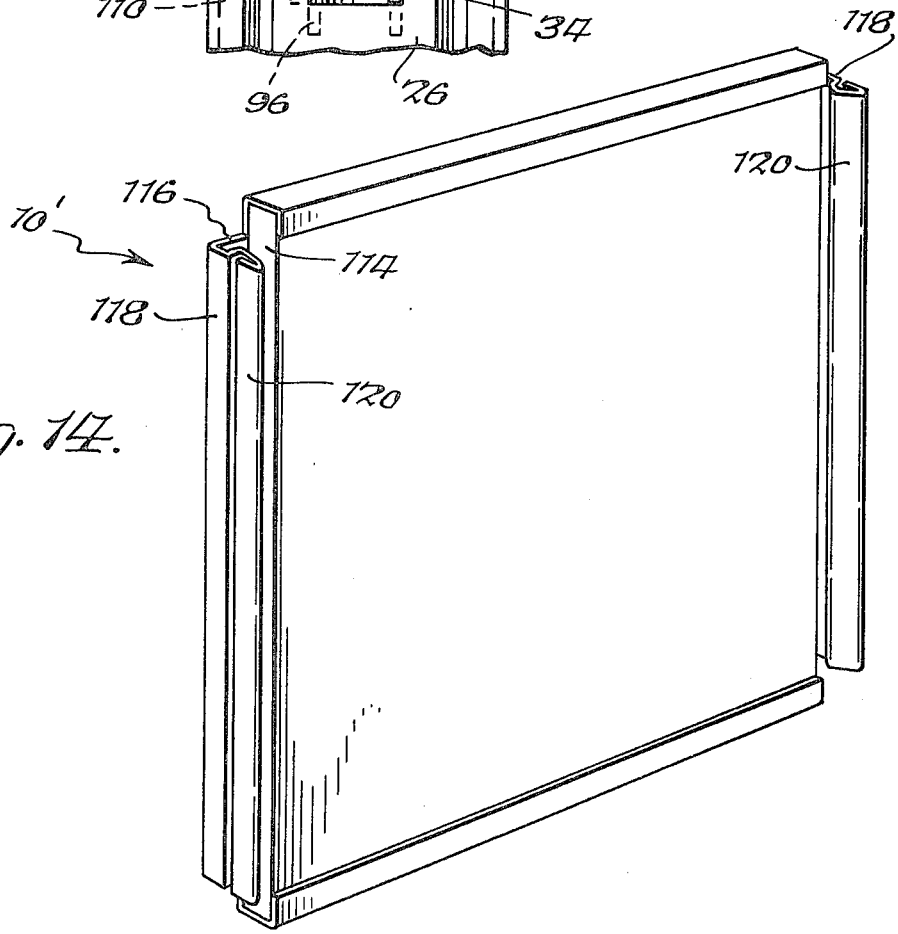
Fig. 14.

MODULAR WALL CONSTRUCTION

This is a division, of application Ser. No. 411,703 filed Nov. 1, 1973, now U.S. Pat. No. 3,925,948.

BACKGROUND OF THE INVENTION

This invention relates generally to the construction art and, more particularly, to certain new and useful wall constructions.

In the wall construction art, it is known to employ prefabricated partition or perimeter walls and many modular arrangements have been proposed in an effort to provide mass produced, low cost construction which can be readily installed and which also can be easily dismantled when it is desired to remove or shift the position of the wall.

While many of these known modular wall constructions are admirably suited for their intended purpose, they possess certain disadvantages. For example, they often require complexly configurated components and connecting attachments which are expensive and present problems in fabrication and assembly, sometimes requiring an inventory of a large number of different parts and the services of skilled personnel for installation. Moreover, such known constructions generally are designed for specific types of wall paneling, thereby severely limiting their versatility in accommodating various types of wall paneling arrangements.

SUMMARY OF THE INVENTION

Accordingly, it is an object of the present invention to provide a modular wall arrangement offering versatility in accommodating various types of wall panel arrangements and having a minimum of parts.

It is another object of this invention to provide wall panel supporting structure including novel stud and detachable clip arrangements for mechanically securing panel members in place.

It is still another object of the present invention to provide the foregoing stud arrangement with extensible means for detachable engagement with ceiling attachment means.

In one aspect thereof, the present invention is characterized by the provision of elongated studs serving as panel bearers and which extend along the side edge portions of the panels in conjunction with clips detachably interlocked with the studs for receiving panel attaching means in the form of batten strips or skirts formed integral with the panel members. Axially adjustable extender clips are insertable in the upper ends of the studs for connecting the studs to ceiling channel members.

The foregoing and other objects, advantages and characterizing features of this invention will become clearly apparent from the ensuing detailed description of certain illustrative embodiments thereof, taken together with the accompanying drawings wherein like reference numerals denote like parts throughout the various views.

BRIEF DESCRIPTION OF THE DRAWING FIGURES

FIG. 5 is a fragmentary, horizontal sectional view, showing a pair of double wall structures joined together at a T intersection;

FIG. 6 is a fragmentary, horizontal sectional view, showing the starting end of a double wall structure;

FIG. 7 is a cross sectional view of a batten strip used with this invention;

FIG. 8 is a fragmentary, horizontal sectional view, showing the use of a batten strip in conjunction with this invention;

FIG. 9 is a fragmentary, horizontal sectional view of a corner construction of this invention;

FIG. 10 is an end elevational view of a clip used in conjunction with the batten strip mounting, the batten strip and stud being shown in cross section;

FIG. 11 is a perspective view of the clip shown in FIG. 10;

FIG. 12 is an end elevational view of the clip of FIG. 11, shown in conjunction with the panel member mounting;

FIG. 13 is a longitudinal sectional view, taken about on line 13—13 of FIG. 12; and FIG. 14 is a perspective view of one form of panel member used in this invention.

DETAILED DESCRIPTION OF AN ILLUSTRATIVE EMBODIMENT

Figure 1:
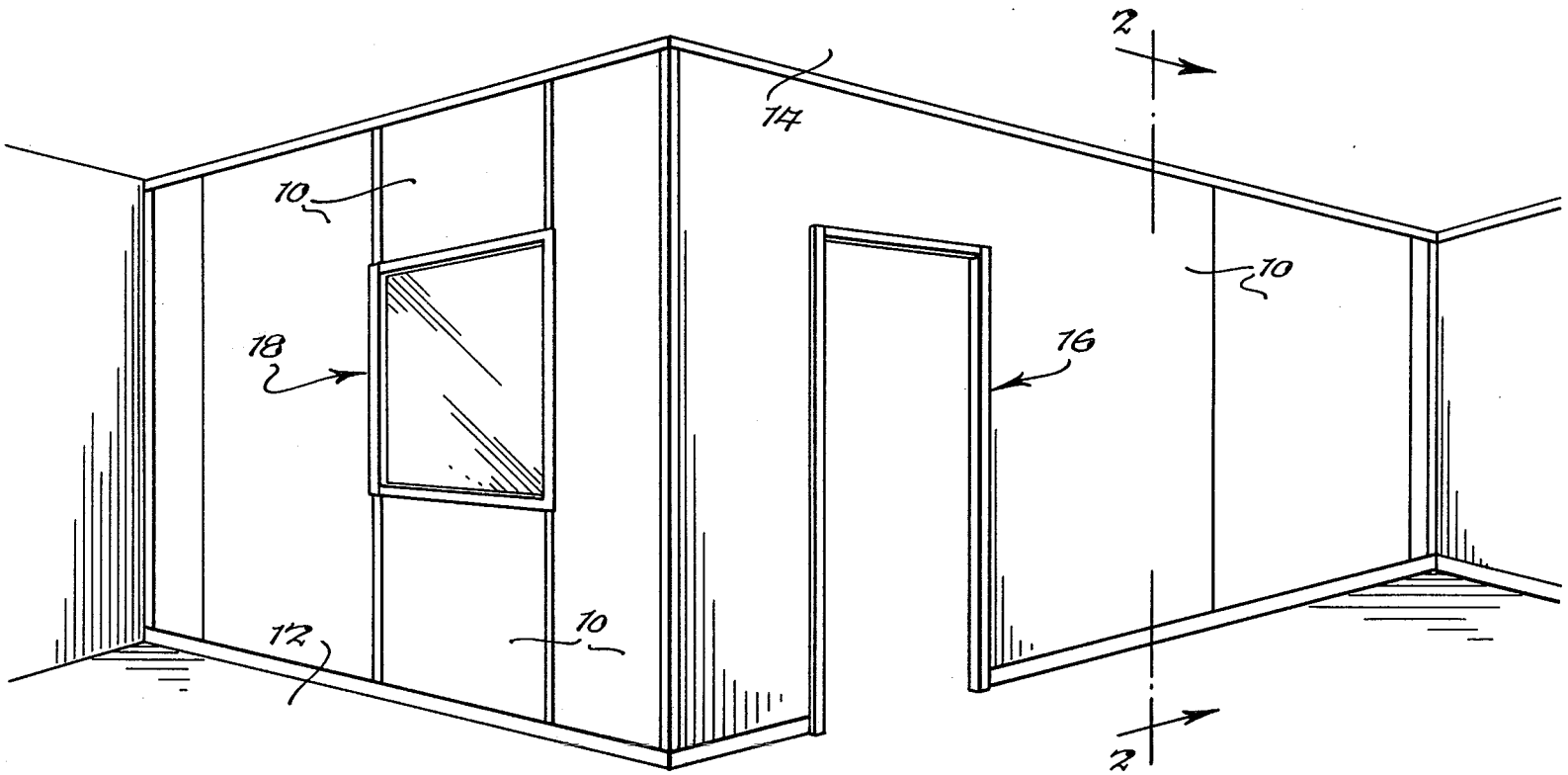
FIG. 1 is a perspective view of a modular wall construction embodying features of the present invention.

Referring now in detail to the illustrative embodiment depicted in the accompanying drawings, there is shown in FIG. 1 a portion of a modular, double wall construction embodying various features of the present invention. The double wall construction comprises opposed panel members 10 (FIG. 2) defining opposite wall surfaces extending from a floor 12 to a ceiling 14 and which meet to form inside and outside corners. This modular wall construction also can include door frame assemblies 16 and windows 18, as desired. It should be understood that the double wall construction of this invention can be used in perimeter walls defining inner and outer surfaces as well as in partition walls, as desired. Also, the features embodied in the present invention are equally applicable to single wall constructions.

In accordance with this invention, panel members 10 are mounted and supported in properly spaced relation by means including metal panel bearers or studs, generally designated 20 (FIG. 2), extending vertically to receive the opposite lateral edges of the supported panel members 10. However, it should be understood that studs 20 can extend horizontally as well as vertically to receive the four side edge portions of the supported panel member 10. Studs 20, whether horizontal or vertical, are maintained in a properly longitudinal spaced relation by spacer bars 22, which extend therebetween as shown for example in FIGS. 3 and 4.

Figure 2:
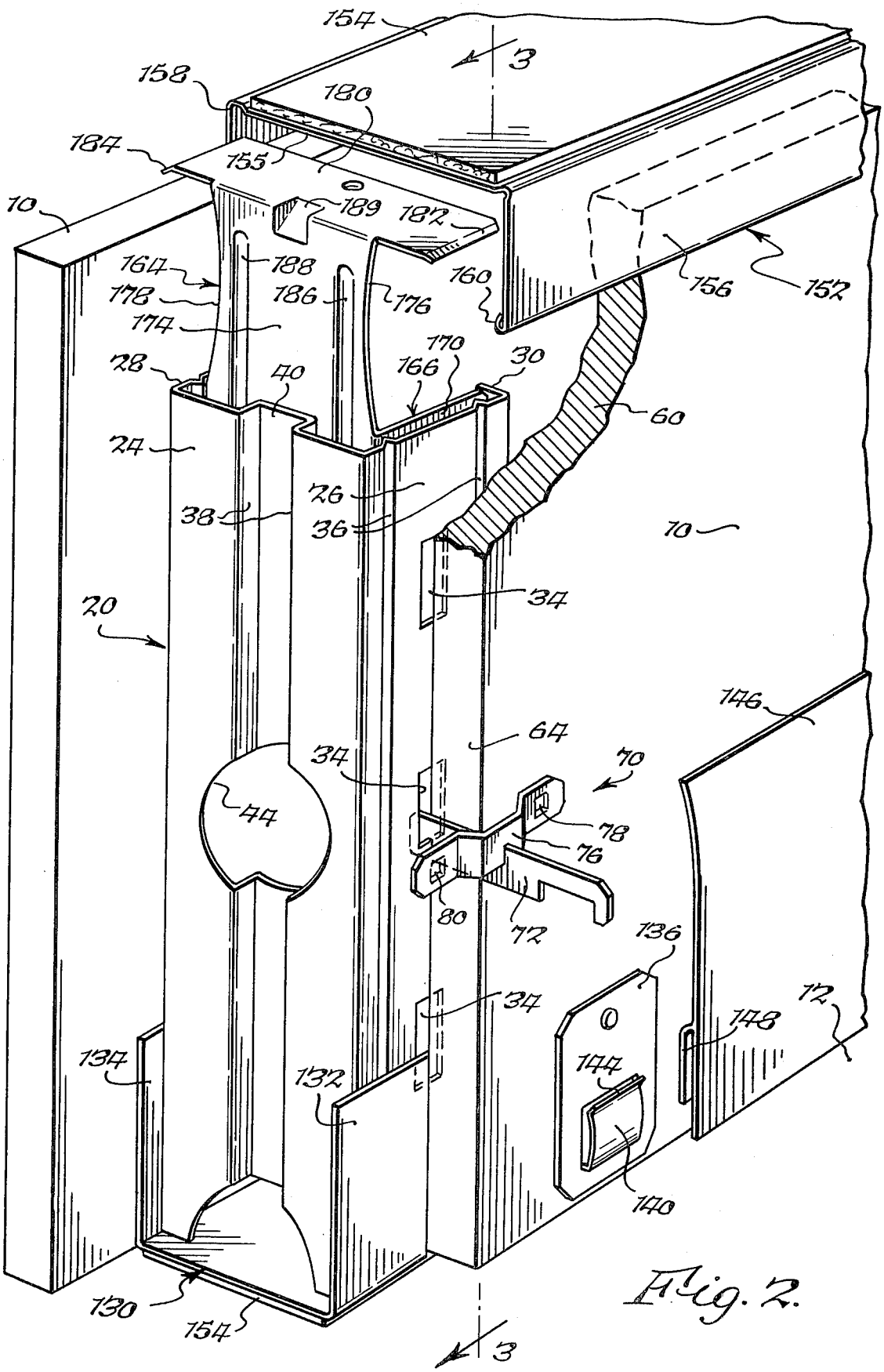
FIG. 2 is a fragmentary, perspective view, primarily in elevation looking in the direction of arrows 2—2 in FIG. 1, and with parts broken away to show details of the stud and extender clip of this invention.
Figure 3:
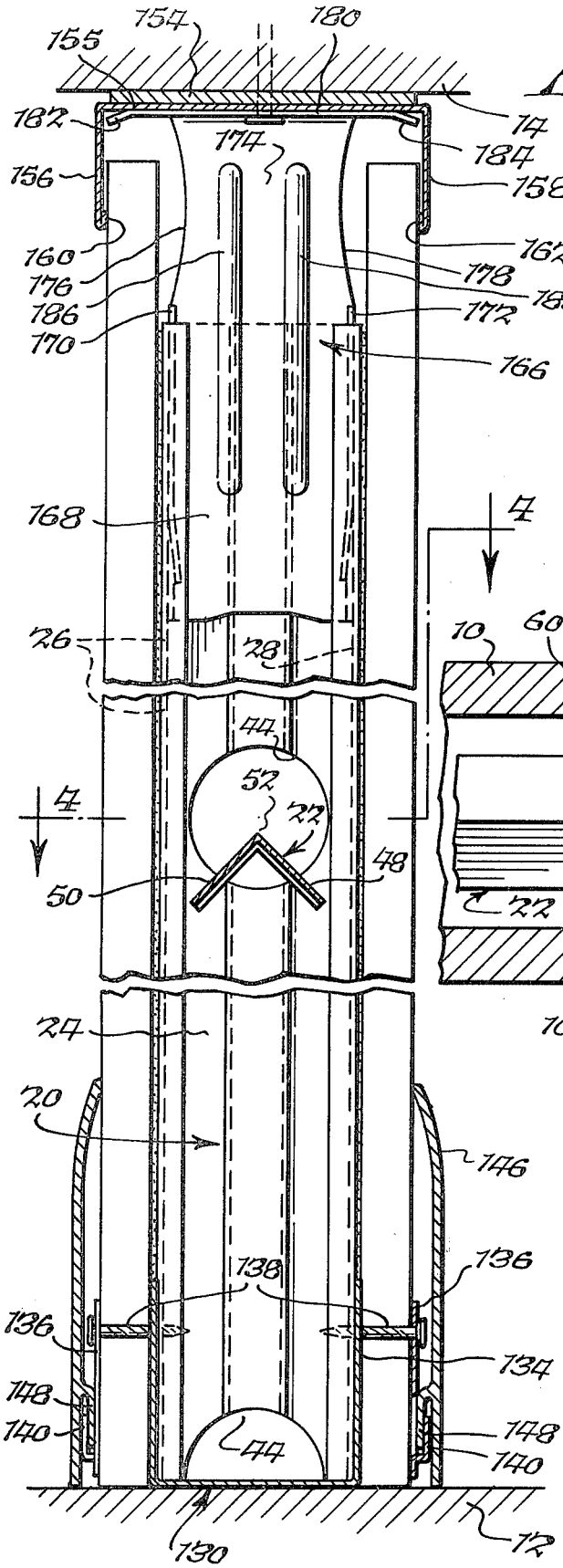
FIG. 3 is an end elevational view, partly in section, taken about on line 3—3 of FIG. 2.

As best shown in FIGS. 2 and 3, studs 20 can comprise a sheet metal fabrication of unitary, one-piece construction formed to provide a channel shaped, rectangular body having a web portion 24, a pair of opposite and parallel side walls 26 and 28 extending from the opposite lateral edges of web portion 24 in a direction normal thereto, and a pair of inturned flanges 30 and 32 formed at the outer ends of side walls 26 and 28 and extending lengthwise thereof in substantial parallelism with web portion 24. A plurality of longitudinally spaced openings or slots 34 are formed in side walls 26 and 28 for the reception of retaining clips, hereinafter described in detail. Also, each of the side walls 26 and 28 is provided with a pair of laterally spaced indentations or grooves 36 of a generally V-shaped configuration in cross section extending lengthwise of side walls 26 and 28. These grooves 36 not only provide pockets for the reception of a suitable adhesive when securing gypsum board panels thereto, but also provide mechanical reinforcement for studs 20 to add rigidity thereto.

Each stud 20 also is formed to provide web portion 24 with an internal channel having inwardly directed, parallel side walls 38 leading to a rear wall 40 and providing an inlet opening 42 through web portion 24. Channel 38–42 extends the full length of stud 20 with the channel proper being entirely confined therewithin. A plurality of longitudinally spaced openings 44, of generally round configuration, are formed in stud web portion 24 for receiving spacer bars 22 therein. Also, openings 44 provide passages for the placement of electric conduits, heating pipes and the like.

Figure 4:
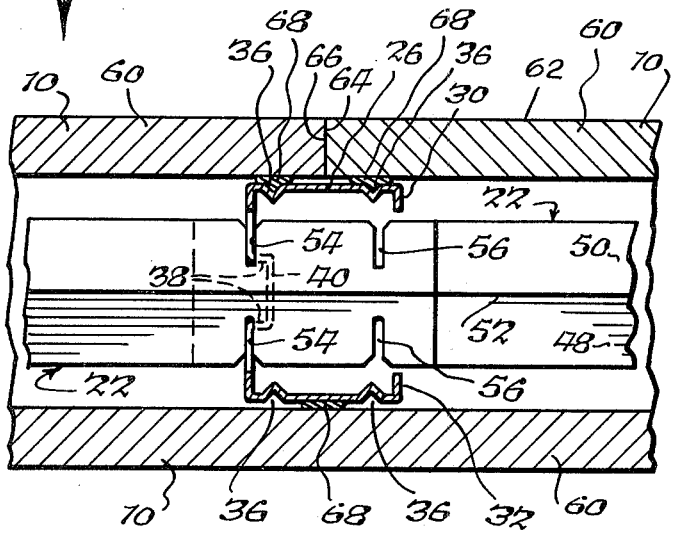
FIG. 4 is a horizontal sectional view, taken about on line 4—4 of FIG. 3.

Spacer bars 22 each comprise an elongated body portion of an inverted V-shaped configuration in cross section and having a pair of inclined legs 48 and 50 joined at an apex juncture 52 and extending downwardly in a diverging relation, as best shown in FIG. 3. Spacer bars 22 extend horizontally and longitudinally along the wall and have a length greater than the spacing between adjacent studs 20 so that the adjacent ends of the former overlap each other as shown in FIG. 4. Each opposite end portion of spacer bar 22 is provided with axially spaced, oppositely directed pairs of slots 54 and 56 extending inwardly from the marginal edges of legs 48 and 50. The opposite ends of each spacer bar 22 are inserted through openings 44 of adjacent studs 20 with slots 54 adjacent one end of spacer bar 22 receiving portions of web 24 and slots 56 at the other end thereof receiving portions of the other stud web portion 24. The overlapping end portions of adjacent spacer bars 22 are arranged in a manner aligning slots 54 of the overlying spacer bar 22 with the slots 56 of the underlying spacer bar 22.

It is contemplated that studs 20 can be utilized in a variety of applications. For example, FIG. 4 illustrates a double wall construction wherein one wall is comprised of a plurality of panel members 10 supported in a lateral edge-to-edge relation against side wall 28 of stud 20. Such panel members 10 comprise a body 60 of gypsum, wall board or any other suitable material, covered with a skin 62 of plastic vinyl or any other suitable thin plastic laminating material which can be painted or otherwise decorated to provide any desired effect. When mounting panel members 10 in place, the inner faces of panel members 10 adjacent their respective lateral edges 64 and 66 are positioned flatly against side wall 26 of stud 20 and affixed thereto by means of a suitable adhesive 68 applied either to such inner panel bearing surfaces or along grooves 36 just prior to positioning panel members 10 against stud 20. The opposed panel members 10 in a double wall construction preferably are staggered so that the parting line defined between edges 64 and 66 of adjacent panel members 10 of one wall are offset from the parting line between adjacent panel member edges 64, 66 of the opposed wall.

In order to temporarily maintain panel members 10 properly positioned against studs 20 until adhesive 68 finally sets, clips 70 are employed to temporarily secure panel members 10 in place. Each clip 70 comprises a thin, elongated strip 72 formed from a suitable sheet metal insertable between the opposed edges 64 and 66 of adjacent panel members 10 and into slot 34 of stud 20. A slot (not shown) is formed in the lower longitudinal edge of strip 72 for receiving and engaging about the edge of stud side wall 26 defining the lower end of stud slot 34. An intersecting cross strip member 76 interlocked or formed integral with strip 72 is provided with a pair of resiliently yieldable, laterally offset, opposite end portions 78 and 80 engagable against the outer faces of adjacent panel members 10 to urge the same against stud 20. After adhesive 68 has properly set, clips 70 can be disengaged from stud 20 and withdrawn from between panel members 10 so as not to interrupt the integrity of the outer wall surface. Such clips 70 are fully disclosed and claimed in application Ser. No. 359,618, filed May 11, 1973, assigned to the same assignee as the present invention, and reference may be had thereto for a detailed description of such clips 70.

In those modular wall constructions incorporating detachable mechanical interlocking arrangements for securing other forms of panel members 10' in place, retainer clips, generally designated 82 (FIGS. 11 12 and 13) are provided for connecting the former to studs 20. As shown in FIG. 11, each retainer clip 82 comprise a generally V-shaped body 84 having a pair of legs 86 and 88 joined together at an apex juncture 89 and extending outwardly therefrom in a diverging relation. These legs 86 and 88 are provided with extensions 90 and 92 extending axially outwardly from legs 86 and 88 and forming continuations thereof. Extensions 90 and 92 are slightly greater in axial dimension than legs 86 and 88 and the transition between the latter and extensions 90 and 92 define opposite pairs of abutment shoulders 94 and 96 for a purpose that will presently become apparent. Extensions 90 and 92 are bowed inwardly toward each other to form shoulder portions 98 and 100 and then flare outwardly to provide a restricted inlet 102 inwardly of the outer ends of extensions 90 and 92 as defined by shoulders 98 and 100.

Oppositely directed spring locking fingers 104 and 106 are struck out from legs 86 and 88 adjacent the opposite marginal edges thereof and project outwardly in opposite directions from the planes of their respective legs 86 and 88. Locking fingers 104 and 106 have stud engaging edges 108 and 110 for locking engagement behind stud side walls 26 and 28 in the assembled relation therewith.

When assemblying a wall in accordance with this invention utilizing clips 82, studs 20 are erected, as will be described in greater detail hereafter, and retainer clips 82 are detachably connected thereto, as shown in FIG. 12. To do this, the rearward or apex juncture 89 of clip 82 is first inserted into stud slot 34. As clip 82 is inserted through slot 34, the outer sides of legs 86 and 88 and fingers 104 and 106 bear against the opposing edges of stud side wall 26 defining slot 34 and legs 86 and 88 along with fingers 104, 106 are cammed inwardly out of the way, permitting fingers 104 and 106 to pass through slot 34. The resiliency of fingers 104 and 106 permits deflection by such camming action without taking a permanent set. Further insertion of clip 82 through slot 34 causes fingers 104 and 106 to pass completely therethrough past stud side wall 26, allowing the resiliently displaced fingers 104 and 106 to snap laterally outwardly away from their respective legs 86 and 88 behind stud side wall 26, as shown in FIG. 12. Fingers 104 and 106 are thereby positioned behind stud side wall 26 with finger edges 108 and 110 in locking engagement thereagainst, preventing withdrawal of clip 82 from slot 34. In this locked position, abutment shoulders 94 and 96 engage the outer side of stud side wall 26 opposite fingers 104 and 106 to block further insertion of clip 82. The spacing between edges 108 and 110 of fingers 104 and 106 and abutment shoulders 94 and 96 is substantially no greater than the thickness of stud side wall 26 to insure a rigid connection between clip 82 and stud 20. Moreover, the tendency of the compressed legs 86 and 88 to restore themselves outwardly to their natural relaxed state causes them to be urged against the opposed edges of stud side wall 26 defining slot 34 to further facilitate a tight connection between clip 82 and stud 20.

With clips 82 secured to studs 20, another form of panel member 10′ (FIGS. 12 and 14) or batten strip 112 (FIG. 7) can be snap-fitted into interlocking engagement with clips 82. It is contemplated that each panel member 10′ will include a body 114 of gypsum, wall board or any other suitable material, preferably covered with a skin 116 of metal or other thin sheet material which can be painted or decorated to provide any desired effect. Further, it is contemplated that skin 116 will extend beyond panel body 114 at its edge portions and will be formed to provide an inturned skirt 118 adapted to be inserted in inlet 102 of clip 82. Skirts 118 are formed with enlarged bulbuous portions 120 at their extremities engagable behind clip shoulder portions 98 and 100 with a snap fit. Therefore, when mounting panel members 10′ in place, they are positioned against studs 20 and the bulbuous portions 120 are snap fitted in place within inlet 102 and behind shoulder portions 98 and 100. While the illustrative panel member 10′ shown in FIG. 14 has skirt portions 118 along the opposite side edges only, it should be understood that such skirt portions can be provided along all four edges, if desired, for interlocking engagement with clips 82 mounted in vertically and horizontally extending studs 20. Also the lengths, widths and thicknesses of panel members 10′ can vary, as desired.

Clips 82 also are used in conjunction with studs 20 when it is desired to use batten strips 112 for detachably securing panel members 10 of the type first described in place rather than adhesively securing the same to studs 20. Each batten strip 112 (FIG. 7) can be conveniently fabricated from a single piece of any suitable material, preferably an inexpensive, lightweight metal such as soft steel for example, and is formed to provide a generally T-shaped body in cross sectional configuration having a web or tongue 122 extending in a direction normal to laterally projecting panel member engaging flanges 124 on opposite sides thereof having inner projections 125 engagable against the outer faces of adjacent wall panels 10. Tongue 122 is formed at its free end with a bulbuous or enlarged head formation 126 which is interlockingly engaged behind shoulder portions 98 and 100 in the assembled relation with clip 82, as shown in FIG. 10, to mechanically secure wall panel members 10 in place.

The means for supporting studs 20 in an upright position includes an elongated base channel member 130 (FIGS. 2 and 3), which is nailed or otherwise fastened to floor 12. The lower end of each stud 20 is slip fitted within base channel 130 with stud side walls 26 and 28 engaging against the inner surfaces of the base channel side walls 132 and 134 with a friction fit. A plurality of base plates 136 are secured to the outer surfaces of panel members 10 along the lower edges of panel members 10 by suitable fasteners 138 extending through panel members 10 and side walls 26 and 28 of studs 20 to secure these components in an assembled relation. A resilient finger 140 extends outwardly and upwardly from adjacent the lower edge of each base plate 136 and is formed to provide an upwardly directed hook portion having an outwardly flaring end portion 144. Plates 136 and fasteners 138 can be covered by decorative strips 146 of a width to extend from floor 12 to above the upper edges of base plates 136. Strips 146 can be made of a suitable plastic material, such as vinyl for example, and formed with downwardly bent resilient fingers 148 adapted to snap fit behind base plate fingers 140 for interlocking engagement therewith to secure strips 146 in place against the lower end of the wall.

The means for supporting the upper end of the wall includes a ceiling track or head channel member 152 nailed or otherwise suitably fastened to ceiling 14 and provided with a strip of resilient cushioning material 154 interposed therebetween to deaden sound transmission between the wall and ceiling 14. Similar cushioning seals 154 can be provided at the floor level, if desired, as shown in FIG. 2. Head channel member 152 is provided with a web portion 155 and opposite side walls 156 and 158 depending downwardly therefrom and terminating in inturned lips 160 and 162 adapted to bear against the outer faces of panel members 10 in the assembled relation therewith.

In order to secure the upper end of each stud 20 to head channel member 152, attaching means in the form of an extender clip, generally designated 164, is provided and comprises an elongated, channel shaped body 166 adapted to be inserted in the upper open end of stud 20 and retained therein with a friction fit. Body 166 has a web 168 in bearing engagement against the rear wall 40 of the channel formed in stud web portion 24 and a pair of flanges 170 and 172 in bearing engagement against the inner surfaces of stud side walls 26 and 28. Elongated opposite slots (not shown) are formed in the lower ends of flanges 170 and 172 and have widths approximating the widths of stud slots 34 for registry therewith so as not to interfere with the insertion of clips 82 through the upper slots 34 of stud 20.

Extender web 168 is provided with an extension 174 having concave lateral edges 176 and 178 for a purpose hereinafter explained. Extension 174 is surmounted by a generally flat head 180 extending in a direction normal to extension 174 and having downwardly inclined flanges 182 and 184 at the opposite ends thereof. Head 180 is received in head channel member 152 and extends transversely thereof in abutting relation thereto. Extension 174 is formed with a pair of longitudinally extending embossments 186 and 188, which extend into web 168, to mechanically reinforce extension 174 for added rigidity. Also, mechanical reinforcement is provided at the juncture of extension 174 with head 180 by means of an inclined embossment 189.

The inclined flanges 182 and 184 facilitate ready insertion of extender head 180 into head channel member 152. The concave edges 176 and 178 on extension 174 provide sufficient clearance to enable panel members 10 to be inserted between such edges 176, 178 and head channel side walls 156, 158 at a slight angle. Once the upper edges of panel members 10 are inserted in such spaces between the extension edges 176, 178 and head channel side walls 156, 158, panel members 10 are swung laterally inwardly into an upright position to bring the inner faces thereof against stud side walls 26 and 28 and the outer faces adjacent the upper ends thereof against lips 160 and 162, as shown in FIG. 3.

When assembling a double wall, vertically aligned base channel member 130 and head channel member 152 are suitably secured to floor 12 and ceiling 14, respectively, with cushioning seals 154 interposed therebetween, as desired. The body 168 of an extender clip 164 is inserted into one end of a stud 20, which is previously cut to length slightly shorter than the ceiling height. In order to position stud 20 in place, head 180 of extender clip is inserted within head channel members 152 with the stud disposed at an inclined angle relative to a true vertical. Then the lower end of stud 20 is swung forwardly into base channel member 130 into a vertical position. Extender clip 164 can then be tapped upwardly relative to stud 20 for a snug fit. The stud can then be properly aligned and plumbed. A second stud 20 having an extender clip 164 mounted therein is then vertically positioned between head channel member 152 and base channel member 130 in the same manner described above at a predetermined distance from the first stud 20, as dictated by the modular spacing between studs 20. Where required, clips 82 can be inserted into the stud side wall slots 34 for snap-fitted interlocking engagement with stud side walls 26 and 28, preferably prior to placement of studs 20 between head and base channel members 152 and 130.

In starting a wall, the first stud 20 is placed against a masonry or otherwise permanent wall 190 (FIG. 6) and secured thereto by a suitable adhesive or any other fastening means, as desired. A sound seal 154 can be sandwiched between wall 190 and stud web portion 24. After positioning successive studs 20 in place, the first pair of opposed panel members 10 can then be vertically positioned against stud side walls 26 and 28 with the upper edges thereof being received within the spaces defined by extender clip edges 176, 178 and head channel member side walls 156 and 158 in the manner heretofore described. Opposed, vertically extending batten strips 112 are then snap fitted to clips 82 with the tongue heads 126 thereof received between extensions 90 and 92 behind shoulder portions 98 and 100 in the manner illustrated in FIG. 10. In the case of a wall start, one of the flanges 124 of each batten strip 112 urges the associated panel member 10 against stud 20 and the opposite flange 124 serves to close the reveal between the edge of such panel member 10 and masonry wall 190. Panel members 10 are thus erected along the entire length of the wall with batten strips 112 mechanically securing panel members 10 to studs 20 and closing the space between adjacent lateral edges thereof, as shown in FIGS. 8 and 10.

In wall starts of those applications employing panel members 10', such as shown in FIGS. 12 and 14, which have skirts 118 provided with bulbuous portions 120 for snap fitted engagement behind clip shoulder portions 98 and 100, batten strips having only one flange 124 can be utilized to close the space between the panel member skirt 118 and masonry wall 190.

It should be understood that the components of the present invention thus far described can be utilized in a variety of combinations to produce the desired joint connections, such as where a partition wall meets another or a perimeter wall at a T intersection or at inside corners, outside corners and the like. For example, there is illustrated in FIG. 5 a double wall structure joined to a right angularly related double wall structure at a T intersection. The means for joining the two wall structures includes an elongated channel member 192 having a web 194 and opposite, parallel side walls 196 and 198 extending in a direction normal to web 194 and terminating in inturned lips 200 and 202. Web 194 is anchored to a panel member 10 of one wall structure by two or more longitudinally spaced fasteners, such as screws 204 for example. A suitable sound seal 154 is interposed between channel web 194 and the outer face of panel member 10 to deaden sound transmission therebetween. Side walls 196 and 198 extend outwardly from web 194 for receiving the opposed panel members 10 of the intersecting wall structure with lips 200 and 202 bearing against the outer faces thereof in the assembled relation therewith.

In a corner construction, such as shown in FIG. 9, the inner walls of a double wall construction are spaced from each other and the outer walls thereof also are spaced from each other to form inner and outer exposed corners. A batten strip 112 is employed to close the space between the end of an inner wall panel member 10 of one of the double walls and the outer face of a right angularly extending inner wall panel member 10 of the other double wall.

Where an outside corner is to be enclosed, an outer corner trim connector, generally designated 206, can be employed as shown in FIG. 9. Trim connector 206 comprises right angularly related faces 208 and 210 having inturned flanges 212 and 214 abutting against the outer faces of the right angularly related outer wall panel members 10. Corner trim connector 206 extends the full height of panel members 10. A tongue 216 projects inwardly from face 210 in substantial parallelism with flange 214 and is provided with a bulbuous portion 218 at the distal end thereof for snap-fitted engagement behind shoulder portions 98 and 100 of clips 82 interlocked with stud 20. Corner trim connector 206 can be painted or otherwise decorated similarly to panel members 10 or in any other suitable manner to provide any desired effect.

From the foregoing, it is apparent that the present invention fully accomplishes its intended objects. Studs 20, in combination with the base and head channel members provide a quickly assembled supporting framework on which wall panel members can be readily attached. Studs 20 can be employed in a variety of ways, offering versatility in accomodating various modes of panel attachments. For example, panel members such as wallboards and the like can be directly secured to the studs by a suitable adhesive, utilizing clips 70 to temporarily hold the panel members in place while the adhesive sets. In another mode of construction, the panel members can be secured in place against studs 20 by means of batten strips 112 having portions interlocking with clips 82 detachably mounted on studs 20. In still another construction, the panel members are provided with integral skirts having portions interlocking with clips 82 for securing the panel members in place. The ends of the studs 20 are joined to ceiling channel members 152 by means of extender clips 164, which are axially adjustable relative to studs 20 for insuring a tight connection between the vertically and horizontally extending members.

An embodiment of this invention having been disclosed in detail, it is to be understood that this has been done by way of illustration only.

We claim:

1. A stud extender clip in combination with a stud having a channel shaped opening and a right angularly related member having a channel shaped opening, said stud extender clip comprising an elongated body having a web and a pair of opposite flanges extending in a direction normal to the plane of said web, an extension formed integral with said web and extending axially therefrom past said flanges, a flat head extending in a direction normal to said extension and formed integral therewith, said head projecting laterally past the lateral edges of said extension and terminating in end portions inclined toward said body wherein said body and said head of said clip are received in said channel shaped openings of said stud and said right angularly related member respectively so that a clearance is provided between said right angularly related member and the opposite lateral edges of said extension whereby the reception of a structural panel therein is facilitated.

2. A stud extender clip comprising: an elongated body adapted for engagement with a stud member having a web and a pair of opposite flanges extending in a direction normal to the plane of said web; an extension formed integral with said web and extending axially therefrom past said flanges wherein the opposite lateral edges thereof are concavely curved inwardly toward each other; a flat head extending in a direction normal to said extension and formed integral therewith; said head projecting laterally past the opposite lateral edges of said extension and terminating in end portions inclined toward said body.

3. A stud extender clip according to claim 2 including a pair of laterally spaced embossments extending longitudinally along said extension and into said body web.

4. A stud extender clip according to claim 2 in combination with a stud having a channel shaped opening and a right angularly related member having a channel shaped opening; said body and said head of said clip being received in said channel shaped openings of said stud and said right angularly related member, respectively.

5. A stud extender clip according to claim 2 in combination with a channel shaped stud having a web portion provided with an axially extending protrusion and a right angularly related channel member having a web portion; said body of said clip being received in said stud with said body web in bearing engagement against said axially extending protrusion and said head of said clip being received in said right angularly related channel member in bearing engagement against said channel member web portion.

* * * * *